US008495933B1

(12) United States Patent
Huang

(10) Patent No.: US 8,495,933 B1
(45) Date of Patent: Jul. 30, 2013

(54) ADJUSTABLE WRENCH

(75) Inventor: Allen Huang, Taichung (TW)

(73) Assignee: Yu-Shiang Huang, North Dist., Taichung (TW)

( * ) Notice: Subject to any disclaimer, the term of this patent is extended or adjusted under 35 U.S.C. 154(b) by 20 days.

(21) Appl. No.: 13/400,133

(22) Filed: Feb. 20, 2012

(51) Int. Cl.
*B25B 13/16* (2006.01)

(52) U.S. Cl.
USPC ..... 81/167; 81/101; 81/145; 81/100; 81/186

(58) Field of Classification Search
USPC ..... 81/165, 167–169, 155, 100
See application file for complete search history.

(56) References Cited

U.S. PATENT DOCUMENTS 737,847 A * 9/1903 Johnson ..... 81/98
1,178,110 A * 4/1916 Stewart ..... 81/100
1,311,610 A * 7/1919 Michael ..... 81/100
7,373,861 B2 * 5/2008 Hsieh ..... 81/177.9
7,520,199 B2 * 4/2009 Stawarski ..... 81/177.8

* cited by examiner

*Primary Examiner* — Monica Carter
*Assistant Examiner* — Melanie Alexander

(57) ABSTRACT

An adjustable wrench includes two plates, a handle unit, a rotary unit and a control unit. Each plate has a first toothed portion. The handle unit is located between the two plates and includes a handle and a toothed ring. The handle has a second toothed portion. The toothed ring has multiple third teeth and multiple fourth teeth. The third teeth are engaged with the second teeth. The fourth teeth are located between the first toothed portions of the two plates. The rotary unit is located between the two plates and has a first jaw and a second jaw. The control unit includes having a controlling member and a resilient member. The controlling member is connected to the plate and has fifth teeth defined in one end thereof. The resilient member contacts the controlling member to engage the fifth teeth with the first and fourth teeth.

9 Claims, 12 Drawing Sheets

A-A

A-A

A-A

A-A

ADJUSTABLE WRENCH

FIELD OF THE INVENTION

The present invention relates to a wrench, and more particularly, to an adjustable wrench with a control unit for controlling the relative position between the handle and the function end.

BACKGROUND OF THE INVENTION

The conventional adjustable wrench is disclosed in U.S. Pat. No. 2,825,254 which discloses a body, jaws and a handle, wherein the body has a passage defined centrally therethrough and three holes are defined in the outside of the body. The movable jaw is movably connected to the passage so as to clamp object between the stationary jaw and the movable jaw. The handle has one end inserted into one of the holes of the body and the user holds the handle to operate the wrench. However, there are only three holes available and the diameter of the holes and the size of the handle are restricted within a limited range so that the body may have maximum number of five holes. Accordingly, the relative angular positions between the body and the handle are restricted.

The present invention intends to provide an adjustable wrench which provides more operations of the relative angular positions between the body and the handle.

SUMMARY OF THE INVENTION

The present invention relates to an adjustable wrench and comprises two plates, a handle unit, a rotary unit and a control unit. Each plate has a first toothed portion. The handle unit is located between the two plates and includes a handle and a toothed ring. The handle has a second toothed portion. The toothed ring has multiple third teeth and multiple fourth teeth. The third teeth are engaged with the second teeth. The fourth teeth are located between the first toothed portions of the two plates. The rotary unit is located between the two plates and has a first jaw and a second jaw. The control unit includes having a controlling member and a resilient member. The controlling member is connected to the plate and has fifth teeth defined in one end thereof. The resilient member contacts the controlling member to engage the fifth teeth with the first and fourth teeth.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
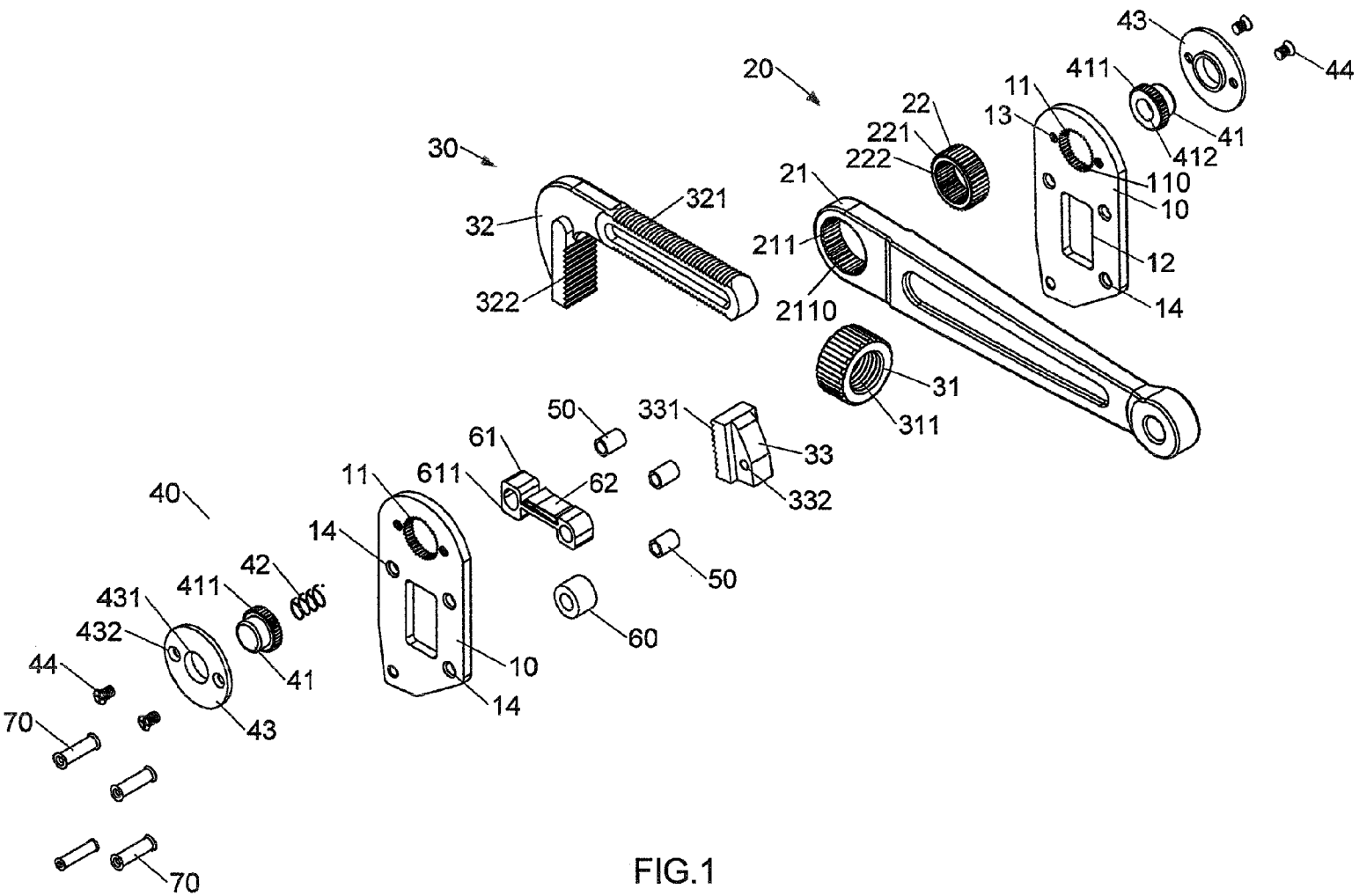
FIG. 1 is an exploded view to show the adjustable wrench of the present invention.

Referring to FIGS. 1 to 4, the adjustable wrench of the present invention comprises two plates 10, a handle unit 20, a rotary unit 30 and a control unit 40.

Each plate 10 has a through hole 12 and a first toothed portion 11 which has multiple first teeth 110 defined in the inner periphery thereof. Two threaded hole 13 are defined beside the first toothed portion 11 and four fixing holes 14 are located close to the through hole 12.

The handle unit 20 is located between the two plates 10 and has a handle 21 and a toothed ring 22. The handle 21 has a second toothed portion 211 defined in a first end thereof and multiple second teeth 2110 are defined in the inner periphery of the second toothed portion 211. The toothed ring 22 has multiple third teeth 221 defined in the outer periphery thereof and the third teeth 221 are engaged with the second teeth 2110. The toothed ring 22 has multiple fourth teeth 222 defined in the inner periphery thereof and the fourth teeth 222 are located between the first toothed portions 11 of the two plates 10.

The rotary unit 30 is located between the two plates 10 and comprises a rotary member 31, a first jaw 32 and a second jaw 33. The rotary member 31 is a ring-shaped member and located in the through holes 12 of the plates 10 and partially protrudes from the two plates 10 so that the users can rotate the rotary members 31 by the protruded portion. The rotary member 31 has a first threaded portion 311 defined in the inner periphery thereof. The first jaw 32 is an L-shaped jaw and has a first operation portion 322 at the first end thereof and a second threaded portion 321 is defined in the second end of the first jaw 32. The second threaded portion 321 is threadedly engaged with the first threaded portion 311. The second jaw 33 has a second operation portion 331 which is located corresponding to the first operation portion 322. When rotating the rotary member 31, the first jaw 32 is moved linearly relative to the second jaw 33 to adjust the distance between the first and second operation portions 322, 331. The second jaw 33 has a passage 332 which is located corresponding to one of the fixing holes 14 in the plates 10.

The control unit 40 has at least one controlling member 41, a resilient member 42, two cover plates 43 and four threading members 44. In the drawings, there are two controlling members 41 and each controlling member 41 is connected to the plate 10. The two controlling members 41 are located corresponding to each other. Each controlling member 41 has multiple fifth teeth 511 defined in the outer periphery thereof and the fifth teeth 511 are engaged with the first teeth 110 and the fourth teeth 222. Each controlling member 41 has a recess 412 in which the resilient member 42 is received between the two recesses 412 of the two controlling members 41. The resilient member 42 applies a force to engage the fifth teeth 411 with the first teeth 110 and the fourth teeth 222. When the controlling members 41 are moved linearly, the resilient member 42 is compressed, and the fifth teeth 411 are disengaged from the first teeth 110 and only engaged with the fourth teeth 222. Each cover plate 43 covers the controlling member 41 and the resilient member 42. Each of the covering plates 43 has a first circular hole 431 and a second circular hole 432. The controlling members 43 partially protrude from the first circular holes 431 and the second circular holes 432 are located corresponding to the threaded holes 13. Each of the threading members 44 extends through the second circular hole 432 of each cover plate 43 and is threadedly connected to the threaded hole 13 of the plate 10 to fix the cover plate 43 to the plate 10.

There are three support rings 50, a roller 60, a block 61, a resilient member 62 and four fixing members 70. The support rings 50 are located between the two plates 10 and each of the support rings 50 is located corresponding to one of the fixing hole 14 corresponding thereto. The roller 60 is made by soft material and freely rotatable along the outside of one of the support rings 50. The outer periphery of the roller 60 contacts and supports the first side of the second threaded portion 321 of the first jaw 32. The block 61 is mounted to two support rings 50 and has an end face 611 which contacts and supports the second side of the threaded portion 321. The resilient member 62 is located between the block 61 and the handle 21. By the force of the resilient member 62, the end face 611 contacts the second side of the threaded portion 321. One of the fixing members 70 is connected between the fixing holes 14 of the two plates 10 and the passage 332 of the second jaw 33. Three of the fixing members 70 are connected between three of the fixing holes 14 of the two plates 10 and the three of the support rings 50. Each of the fixing members 70 can be a rivet or screw.

Figure 2:
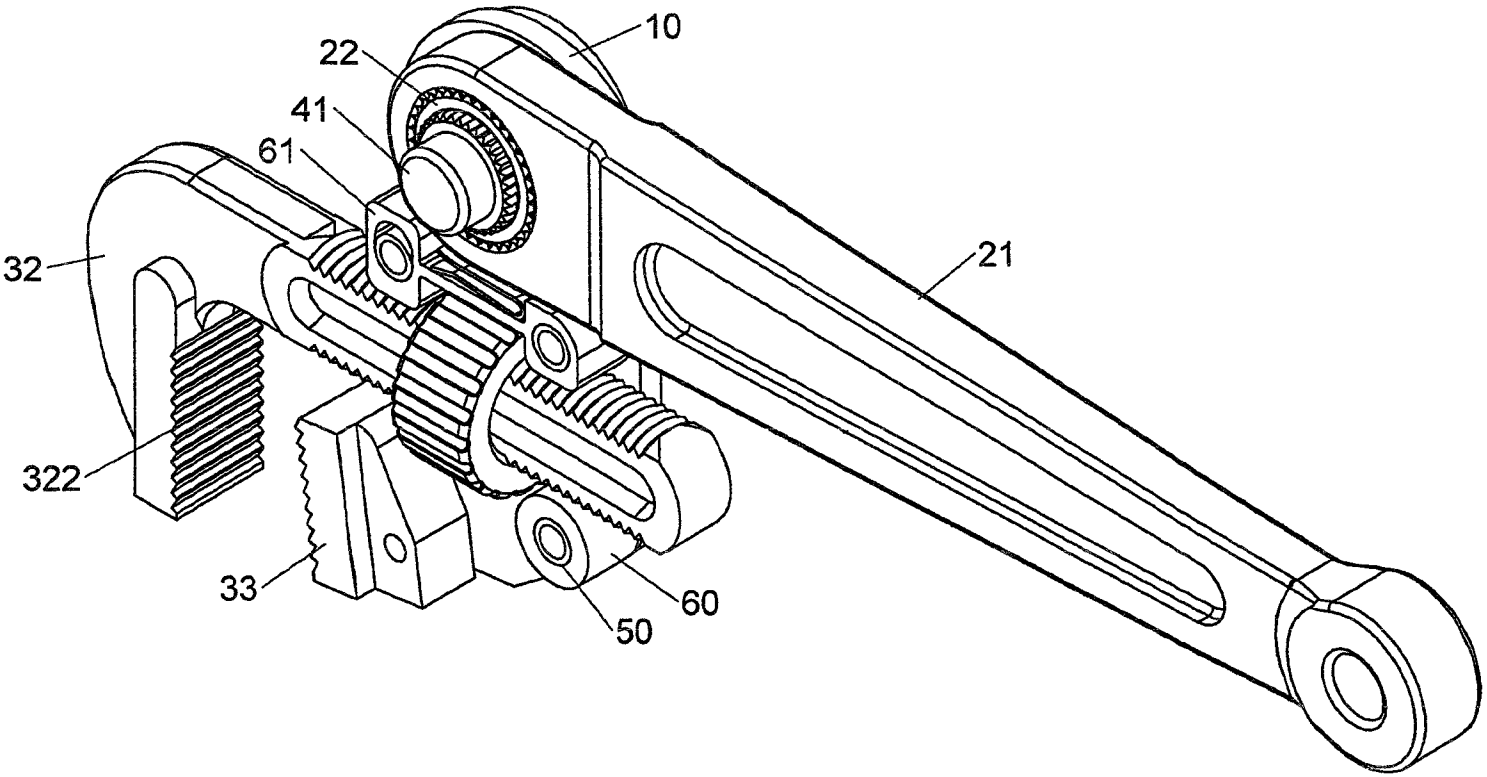
FIG. 2 is a perspective view to show the adjustable wrench of the present invention, wherein the plates are not installed yet.
Figure 3:
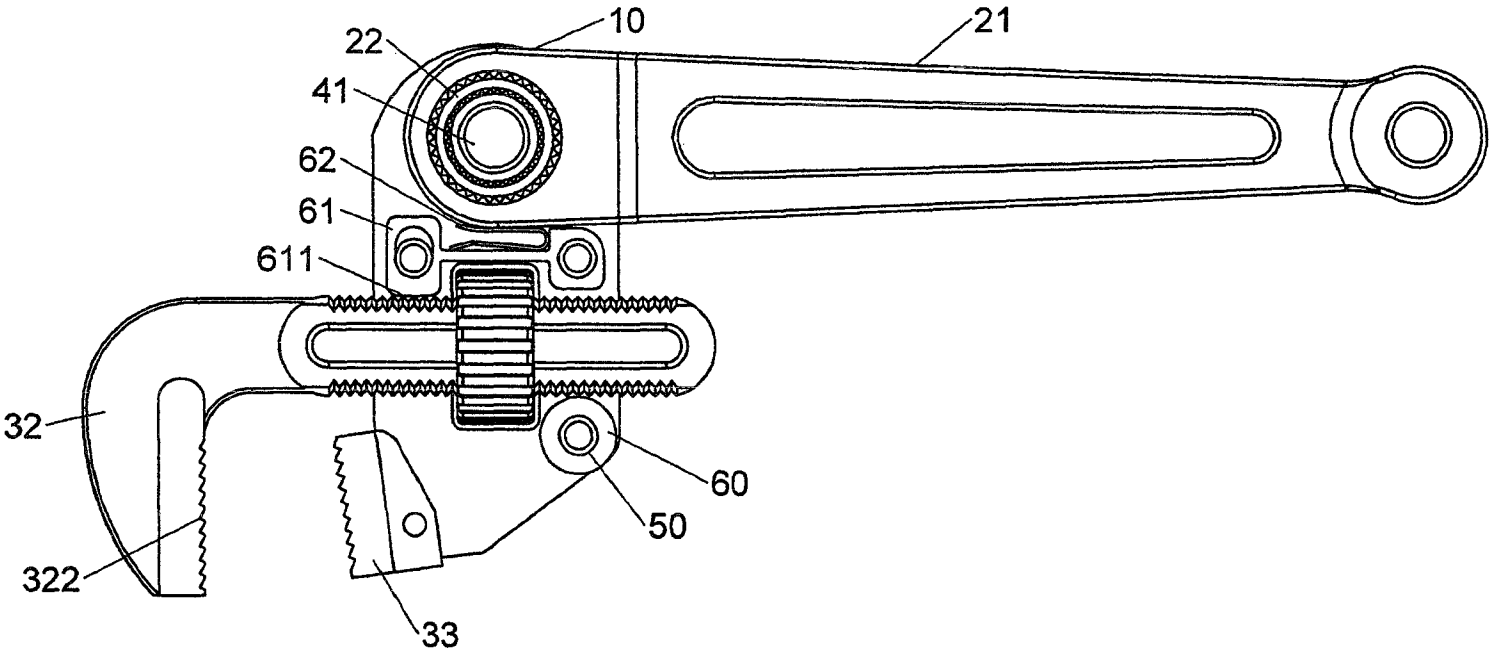
FIG. 3 is a side view of the adjustable wrench of the present invention shown in FIG. 2.
Figure 4:
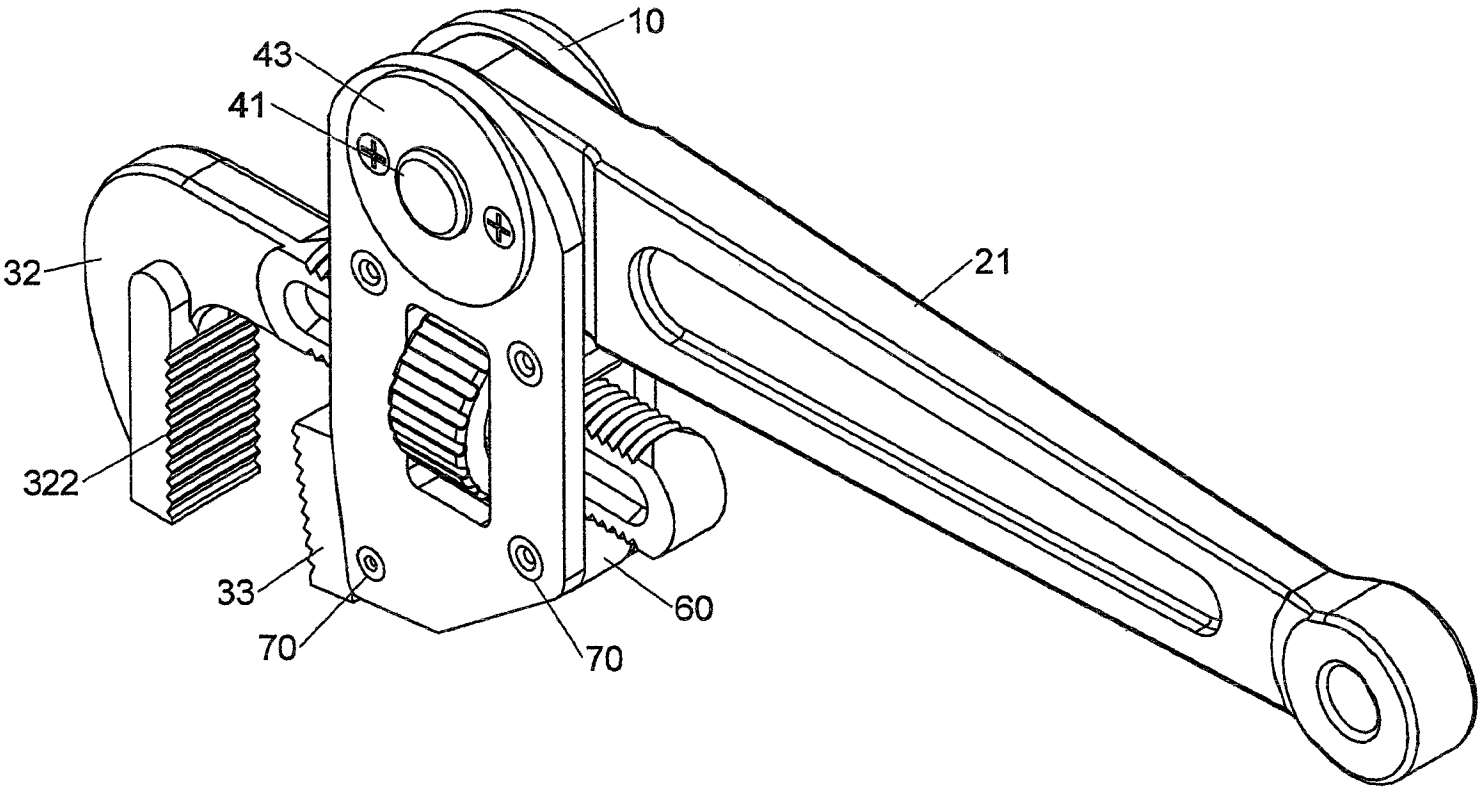
FIG. 4 is a perspective view to show adjustable wrench of the present invention.

When assembling, one plate 10, the handle unit 20, the rotary unit 30, two controlling member 41, the resilient member 42, one covering plate 43, three support rings 50, the roller 60, the block 61 and the resilient member 62 are assembled the wrench as shown in FIGS. 2 and 3. The other plate 10 is connected to the plate 10 of the wrench in FIGS. 2 and 3, the two covering plates 43 are connected to the two plates 10. The four threading members 44 extend through the two covering plates 43 and are threadedly connected to the threaded holes 13. The two fixing members 70 are respectively connected between the fixing holes 14 of the two plates 10 and the passage 332, and between the three fixing holes 14 and the three support rings 50 to complete the wrench shown in FIG. 4.

Figure 5:
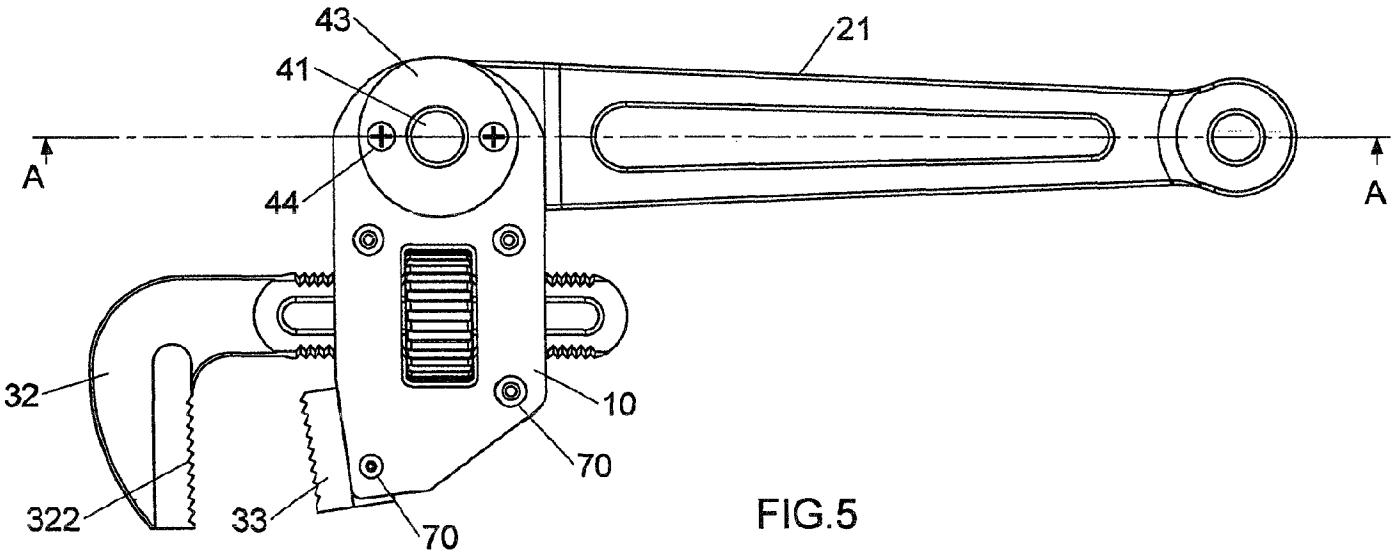
FIG. 5 is a side view of the adjustable wrench of the present invention shown in FIG. 4.
Figure 6:
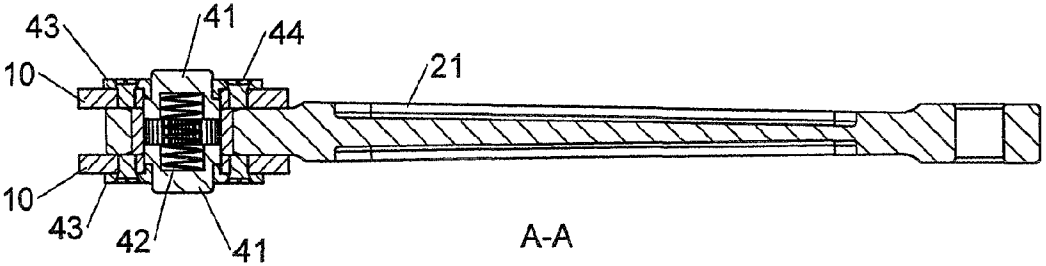
FIG. 6 is a cross sectional view, taken along line A-A in FIG. 5.

As shown in FIGS. 5 and 6, the handle unit 20 and the rotary unit 30 are located between the two plates 10. The fifth teeth 411 of the tow controlling members 41 are engaged with the first teeth 110 and the fourth teeth 222 of the toothed ring 22. The resilient member 42 is located between the two controlling members 41. The four threading members 44 connect the two covering plates 43 to the two plates 10, so that the two covering plate 43 cover the controlling members 41 and the resilient member 42. The four fixing members 70 connected the fixing holes 14 of the two plates 10 to connect the two plates 10 to each other.

Figure 7:
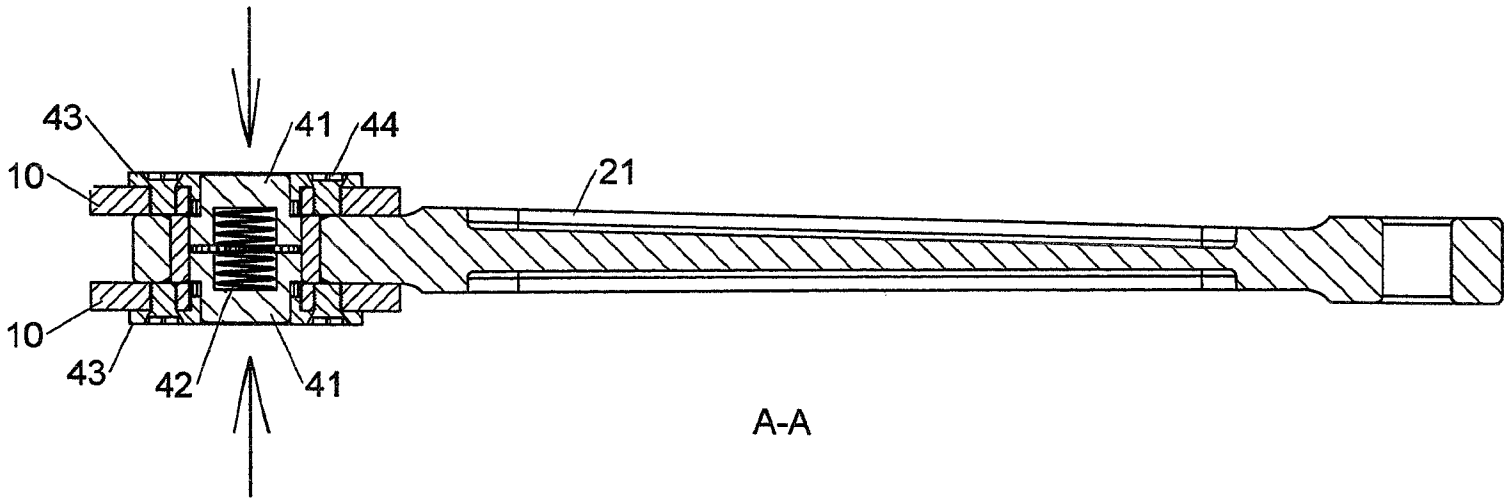
FIG. 7 is a cross sectional view to show the operational status of the adjustable wrench of the present invention.
Figure 8:
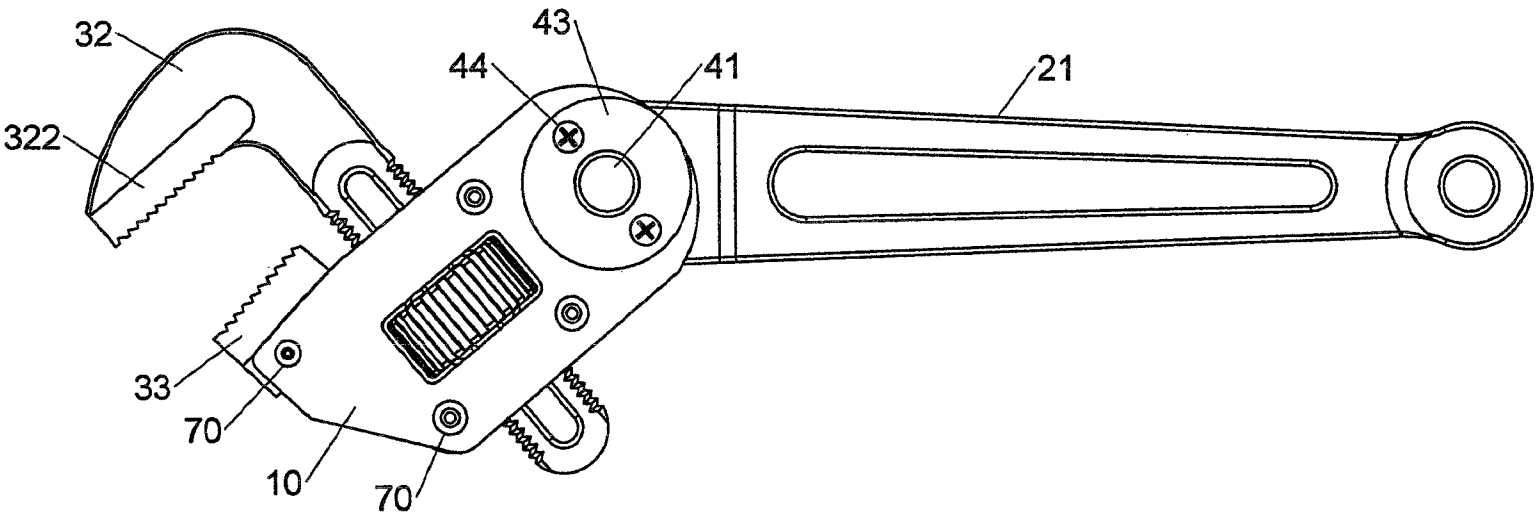
FIG. 8 shows that the function end of the wrench is adjusted.

As shown in FIGS. 7 and 8, when pressing the two controlling members 41 of the control unit 40, the two controlling members 41 are moved linearly and the resilient member 42 is compressed. The fifth teeth 411 of the two controlling members 41 are only engaged with the fourth teeth 222 of the toothed ring 22. The handle 21 is then rotated to adjust the relative angle between the plates 10 and the handle 21. The handle 21 can be rotated 180 degrees relative to the plates 10. When adjusting the angle, the handle 21 does not restricted by other parts of the wrench.

Figure 9:
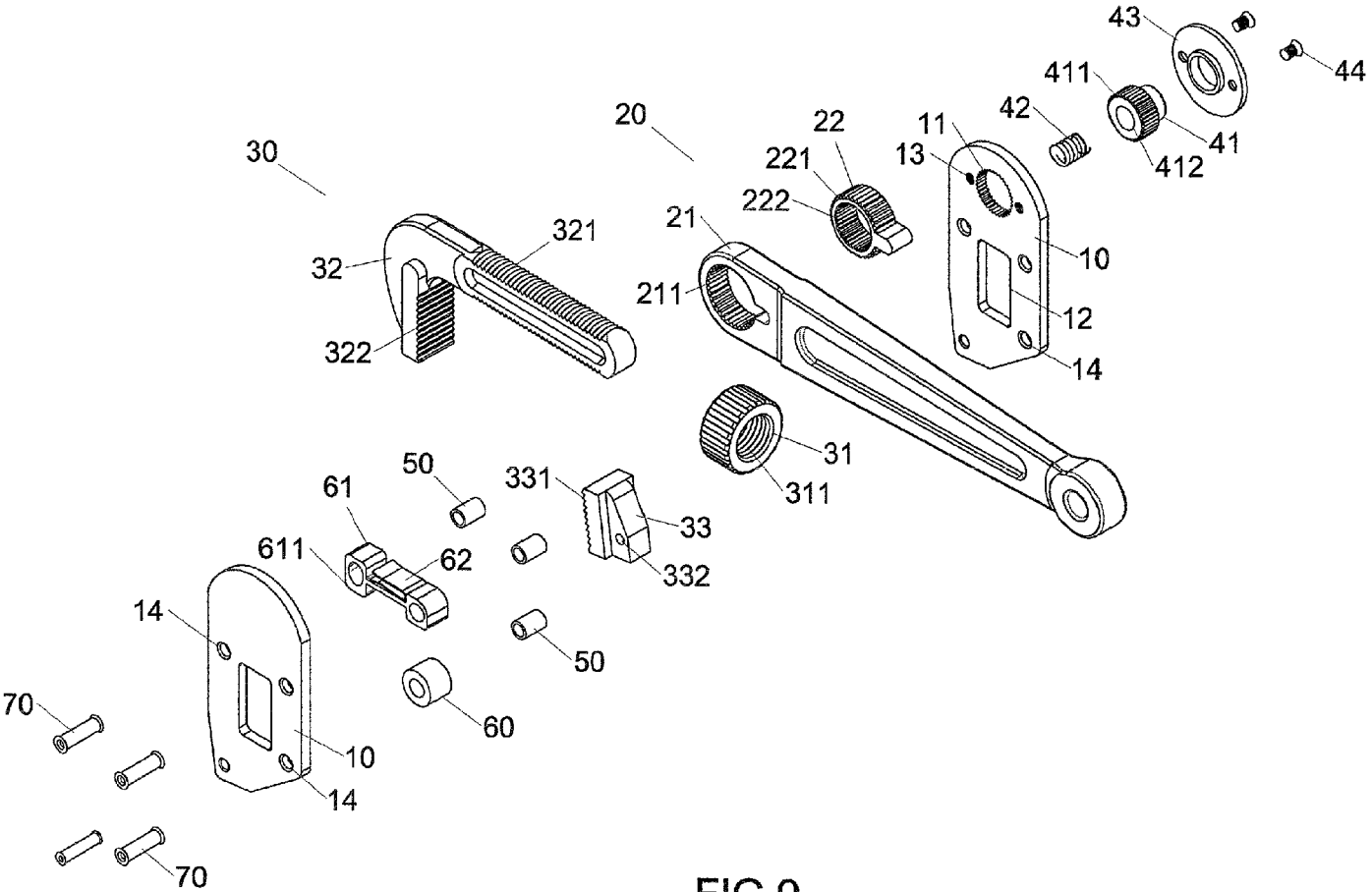
FIG. 9 is an exploded view to show the second embodiment of the adjustable wrench of the present invention.
Figure 10:
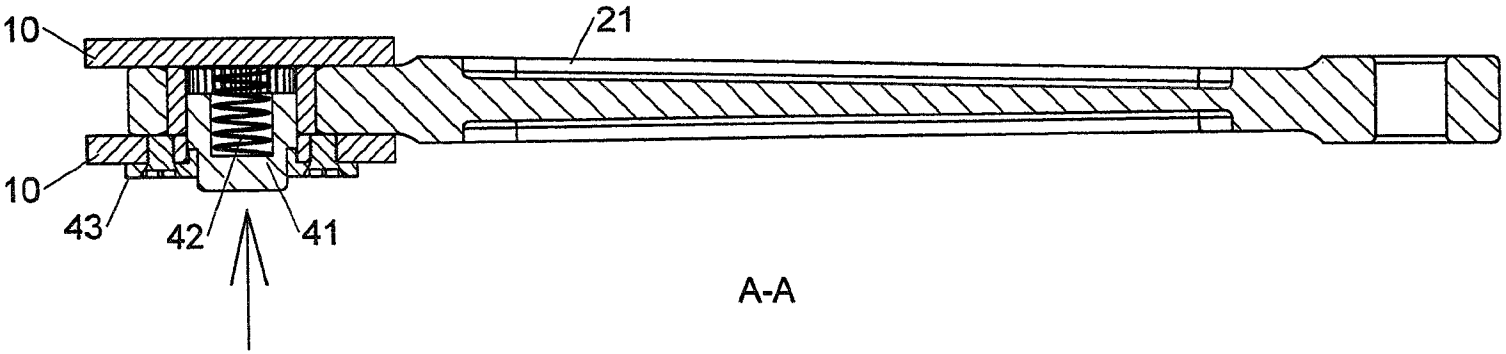
FIG. 10 is a cross sectional view of the adjustable wrench of the present invention shown in FIG. 9.

FIGS. 9 and 10 show the second embodiment, wherein one of the plates 10 does not have the first toothed portion 11 and the two threaded holes 13. The control unit 40 only has one controlling member 41, one covering plate 43 and two threading members 44. The resilient member 42 is located between the recess 412 of the controlling member 41 and the inside of the plate 10. When comparing the embodiments of FIGS. 6 and 10, the control unit 40 in FIG. 6 is operated from both sides, and the control unit 40 of FIG. 10 is operated from one side.

Figures 11, 12:
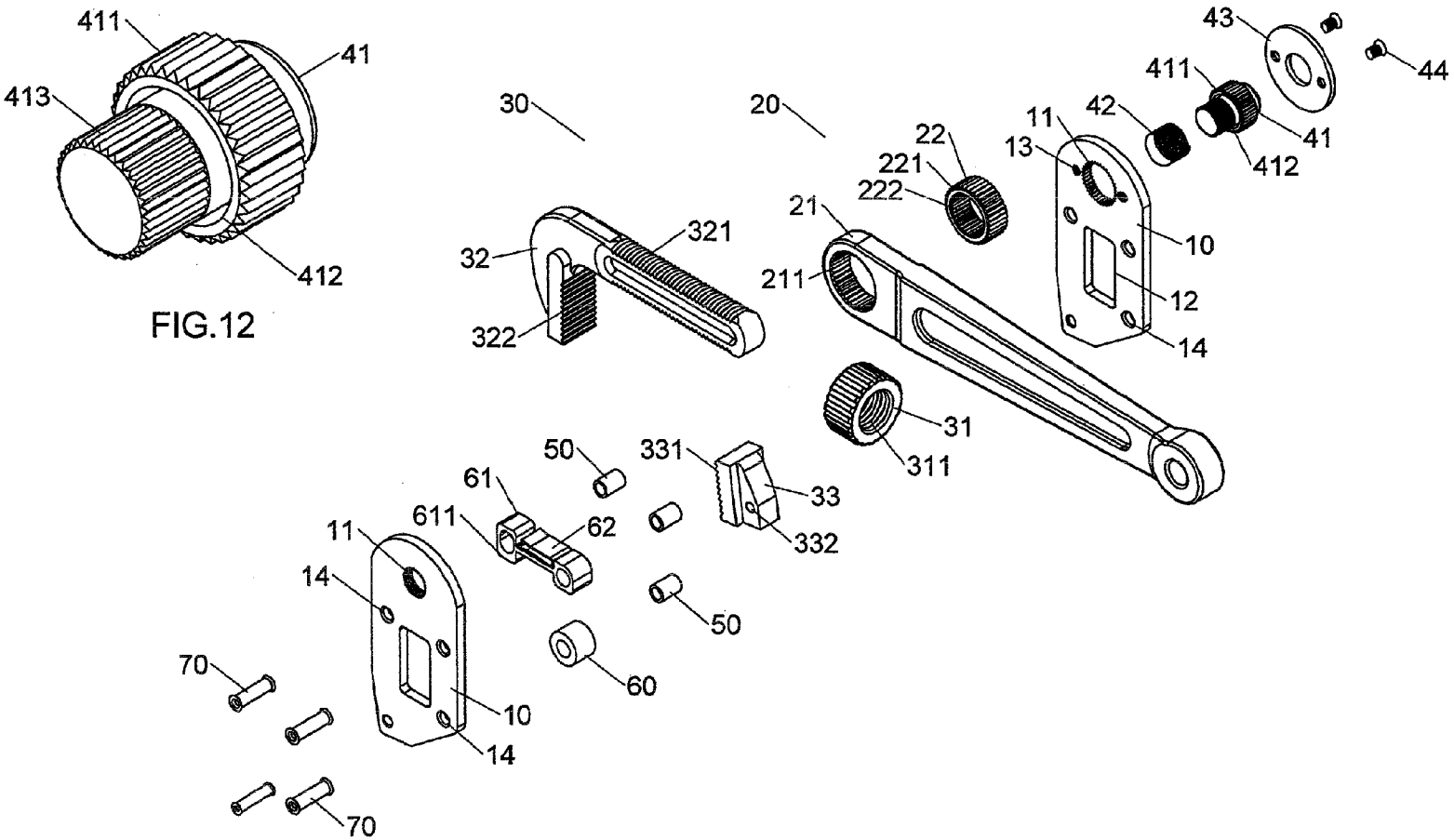
FIG. 11 is an exploded view to show the third embodiment of the adjustable wrench of the present invention.
FIG. 12 shows the controlling member of the adjustable wrench of the present invention shown in FIG. 11.
Figure 13:
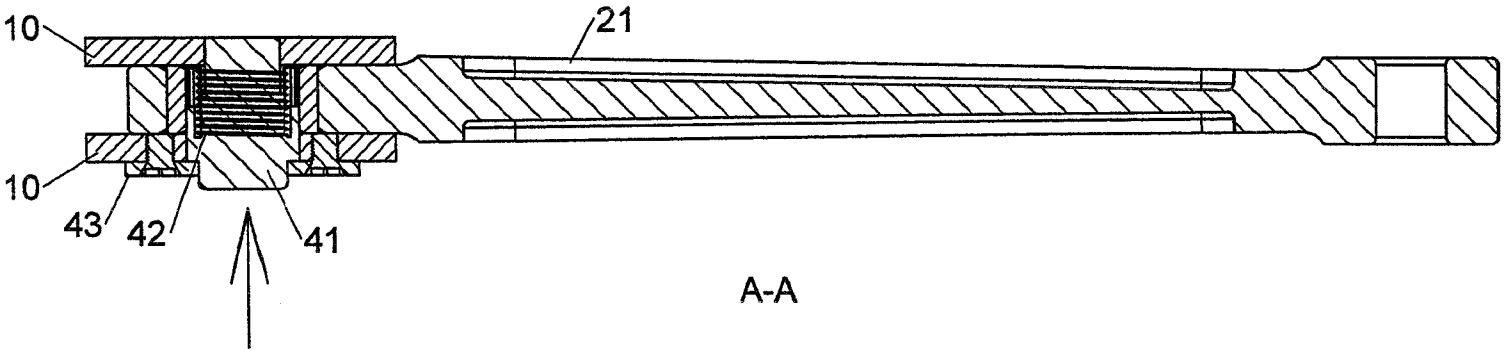
FIG. 13 is a cross sectional view to show the third embodiment of the adjustable wrench of the present invention.

FIGS. 11 and 13 show the third embodiment, wherein the diameter of the first toothed portion 11 of one plate 10 is smaller than that of the other first toothed portion 11 of the other plate 10. The other plate 10 does not have the two threaded holes 13. The control unit 40 has only one controlling member 41, a covering plate 43 and two threading members 44. The controlling member 41 has fifth teeth 411, the recess 412 and the sixth teeth 413. The fifth teeth 411 are engaged with the first teeth 110 of one of the plates 10 and the fourth teeth 222 of the toothed ring 22. The sixth teeth 413 are engaged with the first teeth 110 of the first toothed portion 11 with the smaller diameter. The resilient member 42 is received between the recess 412 of the controlling member 41 and the inside of the plate 10.

Figure 14:
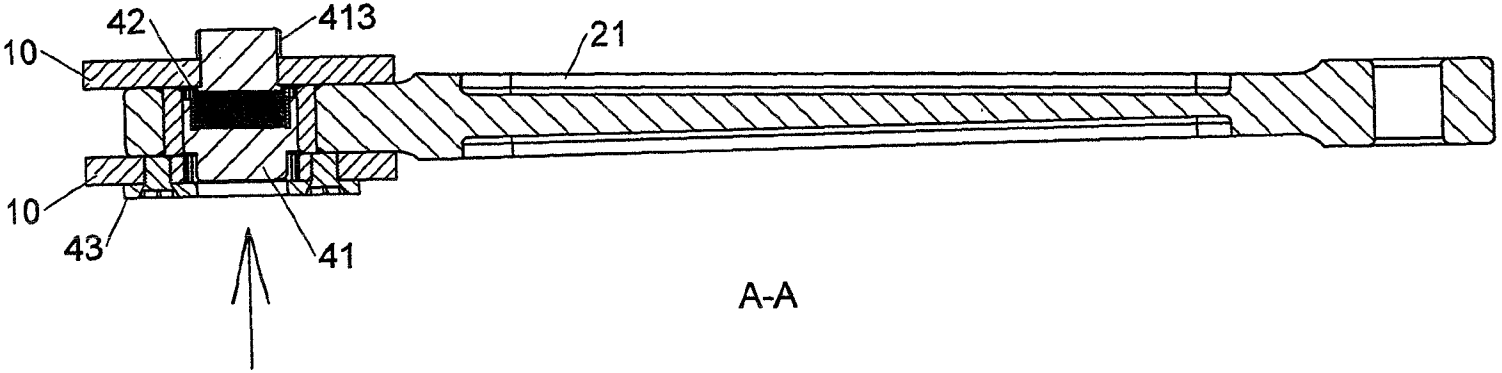
FIG. 14 is a cross sectional view to show the operational status of the adjustable wrench of the present invention shown in FIG. 11.

As shown in FIG. 14, when compressing the controlling member 41, the controlling member 41 is moved linearly and the fifth teeth 41 of the controlling member 41 are disengaged from the first teeth 110 of one of the plates 10, and are only engaged with the fourth teeth 222. The sixth teeth 413 are disengaged from the first teeth 110 of the other plate 10. The control unit 40 of the embodiment is locked on two sides, and operated from one side.

When operating the third embodiment, the toothed ring 22 and the handle 21 are made integrally to each other and the handle 21 has the fourth teeth 222. The two plates 10 are integrally made to each other and in a U-shaped form. The fixing hole 14 of one of the two plates 10 is a through hole and the fixing hole 14 of the other plate 10 is a threaded hole. The fixing member 70 is a screw and extends through the through hole in one plate 10 and is threaded connected to the threaded hole in the other plate 10. The rotary unit 30 has multiple mechanisms to adjust the distance between the first and second operation portions 322, 331. The roller 60 and the support 50 are made integrally to each other.

The advantage of the present invention is that the first toothed portion 11, the fourth teeth and the fifth teeth 411 of the controlling member 41 are arranged annularly so that there are multiple options when adjusting the angle between the plates 10 and the handle 21. There are 360 options if there are 36 teeth.

While we have shown and described the embodiment in accordance with the present invention, it should be clear to those skilled in the art that further embodiments may be made without departing from the scope of the present invention.

What is claimed is:

1. An adjustable wrench comprising:

two plates and each plate having a through hole, at least two threaded holes and multiple fixing holes, at least one of the two plates having a first toothed portion which has multiple first teeth extending from an inner periphery thereof;

a handle unit located between the two plates and having a handle and a toothed ring, the handle having a second toothed portion defined in a first end thereof and multiple second teeth defined in an inner periphery of the second toothed portion, the toothed ring having multiple third teeth defined in an outer periphery thereof, the third teeth engaged with the second teeth, the toothed ring having multiple fourth teeth defined in an inner periphery thereof;

a rotary unit located between the two plates and having a rotary member, a first jaw and a second jaw, the rotary member being a ring-shaped member and located in the through holes of the plates and partially protruding from the two plates, the rotary member having a first threaded portion defined in an inner periphery thereof, the first jaw being an L-shaped jaw and having a first operation portion at a first end thereof and a second threaded portion defined in a second end of the first jaw, the second threaded portion threadedly engaged with the first threaded portion, the second jaw having a second operation portion which is located corresponding to the first operation portion, when rotating the rotary member, the first jaw moved relative to the second jaw to adjust a distance between the first and second operation portions, the second jaw having a passage which is located corresponding to one of the fixing holes in the plates;

a control unit having at least one controlling member, at least one resilient member, at least one cover plate and multiple threading members, the at least one controlling member connected to the plate and having multiple fifth teeth defined in an outer periphery thereof, the at least one controlling member having a recess in which the at least one resilient member is received, the at least one resilient member engaging the fifth teeth, the first teeth and the fourth teeth with each other, when the at least one controlling member is moved, the at least one resilient member is compressed, the fifth teeth are disengaged from the first teeth and engaged with the fourth teeth, the at least one cover plate covering the controlling member and the resilient member, the at least one covering plate having a first circular hole and a second circular hole, the at least one controlling member partially protruding from the first circular hole, the threading member extending through the second circular hole and threadedly connected to the threaded hole of the plate to fix the cover plate to the plate;

multiple support rings located between the two plates and one of the support rings located corresponding to one of the fixing holes;

a roller made by soft material and located an outside of one of the support rings, an outer periphery of the roller contacting and supporting a first side of the second threaded portion of the first jaw;

a block mounted to two support rings and having an end face which contacts and supports a second side of the threaded portion, and multiple fixing members and one of the fixing members connected between the fixing holes of the two plates and the passage of the second jaw, three of the fixing members connected between three of the fixing holes of the two plates and the three of the support rings.

2. The wrench as claimed in claim 1, wherein the toothed ring and the handle are made integrally to each other and the handle had the fourth teeth.

3. The wrench as claimed in claim 1, wherein the two plates are integrally made to each other and in a U-shaped form.

4. The wrench as claimed in claim 1, wherein the roller and the support are made integrally to each other.

5. The wrench as claimed in claim 1, wherein the fixing members are rivets.

6. The wrench as claimed in claim 1, wherein the fixing hole of one of the two plates is a through hole and the fixing hole of the other plate is a threaded hole, the fixing member is a screw and extends through the through hole in one plate and is threaded connected to the threaded hole in the other plate.

7. The wrench as claimed in claim 1, wherein each of the two plates has a first toothed portion, the control unit has two controlling members and two resilient members, each of the controlling members has one resilient member.

8. The wrench as claimed in claim 1, wherein each of the two plates has a first toothed portion, a diameter of the first toothed portion of one plate is smaller than that of the other first toothed portion of the other plate, the at least one controlling member has multiple sixth teeth, the fifth teeth are engaged with the first teeth of one of the plates and the fourth teeth, the sixth teeth are engaged with the first teeth of the first toothed portion with the smaller diameter.

9. The wrench as claimed in claim 1, wherein there are four fixing holes and four threading members.

* * * * *